US007523768B2

(12) United States Patent
Chassaing

(10) Patent No.: US 7,523,768 B2
(45) Date of Patent: Apr. 28, 2009

(54) INSTALLATION FOR THE FILLING OF A RECEPTACLE, IN PARTICULAR AN AEROSOL RECEPTACLE

(75) Inventor: Antoine Chassaing, Clevilliers (FR)

(73) Assignee: Fillon Investissement, Faverolles (FR)

( * ) Notice: Subject to any disclaimer, the term of this patent is extended or adjusted under 35 U.S.C. 154(b) by 429 days.

(21) Appl. No.: 11/416,185

(22) Filed: May 3, 2006

(65) Prior Publication Data

US 2007/0084522 A1 Apr. 19, 2007

(30) Foreign Application Priority Data

Oct. 13, 2005 (FR) ..... 05 10468

(51) Int. Cl.
*B65B 31/00* (2006.01)
*B65B 3/04* (2006.01)

(52) U.S. Cl. ..... 141/20; 141/97; 141/369

(58) Field of Classification Search ..... 141/18, 141/20, 21, 94, 97, 369–370; 53/77, 85
See application file for complete search history.

(56) References Cited

U.S. PATENT DOCUMENTS

| | | | | |
|---|---|---|---|---|
| 1,244,508 | A * | 10/1917 | Kramer | 53/85 |
| 4,911,212 | A * | 3/1990 | Burton | 141/94 |
| 5,377,724 | A * | 1/1995 | Ray | 141/20 |
| 5,507,329 | A * | 4/1996 | Shub | 141/18 |
| 5,740,841 | A * | 4/1998 | Hirz | 141/20 |
| 6,138,720 | A * | 10/2000 | Zeigler | 141/20 |
| 6,302,163 | B1 * | 10/2001 | Zeigler | 141/20 |
| 7,000,650 | B2 * | 2/2006 | Desjardins et al. | 141/20 |
| 2006/0042717 | A1 * | 3/2006 | Faure | 141/20 |

FOREIGN PATENT DOCUMENTS

| | | |
|---|---|---|
| EP | 0 440 477 | 1/1991 |

* cited by examiner

*Primary Examiner*—Timothy L Maust
*Assistant Examiner*—Nicolas A Arnett
(74) *Attorney, Agent, or Firm*—Young & Thompson

(57) ABSTRACT

An installation for filling a receptacle includes at least one frame delimiting a chamber closed at least partially by a protective door for the reception of an aerosol receptacle to be filled with liquid product, this chamber housing, elements for holding a cup adapted to receive the product to be filled at a position located above the place for reception of the aerosol receptacle in a position of contact with the valve of the aerosol receptacle, and a pusher element movable between at least two operative positions to give rise, by pressing on the liquid contained in the cup, the transfer of this liquid through an opening of the cup into the aerosol receptacle. The movement of the pusher element between its different operative positions is controlled by the movement of opening the protective door.

9 Claims, 2 Drawing Sheets

INSTALLATION FOR THE FILLING OF A RECEPTACLE, IN PARTICULAR AN AEROSOL RECEPTACLE

FIELD OF THE INVENTION

The present invention relates to an installation for filling a receptacle, in particular an aerosol receptacle, this installation comprising at least one frame delimiting a closed chamber through a protective door for receiving an aerosol receptacle to be filled with liquid product, this chamber housing, on the one hand means for holding a cup adapted to receive the product to be filled at a location located above the place for receiving the aerosol receptacle in a position of contact with the valve of the aerosol receptacle, on the other hand a pusher element movable between at least two operative positions to give rise, by pressing on the liquid content in the cup, to the transfer of this liquid through an opening of said cup into the aerosol receptacle.

BACKGROUND OF THE INVENTION

Such installations are well known to those skilled in the art, as shown in particular by the patent EP 0 440 477.

In such installations, the cup is provided, at its bottom, with an injection opening adapted to the valve of an aerosol receptacle pre-filled with propulsive gas to permit, with the help of a jack of a piston, the transfer of the contents of the cup, such as paint, into the aerosol receptacle. Once this latter is filled with the liquid product to be received, the diffuser is placed on the valve of the receptacle. The actuation of the diffuser permits rejection of the liquid contained in the receptacle.

Installations permitting such a filling always define a chamber closed at least partially by a door, this door being necessarily maintained closed for reasons of safety during operation of transfer of the liquid corresponding to the movement of the piston in the direction of the bottom of the cup. In the course of this transfer, the piston applies a pressure force to the surface of the liquid contained in the cup. Up till now, the safety device, for holding the door in closed position during the transfer operation, has been constituted by a contactor positioned on the frame, the closing. of the door giving rise to actuation of the contactor and correspondingly to the possibility for the piston to operate. The contactor thus serves only to stop the movement of the piston in case of opening the door. It does not permit in any case controlling a movement of the piston. To permit a movement of the piston, the frame comprises a control member, such as a pushbutton, whose actuation gives rise to the insertion or withdrawal of the piston.

This combination of a contactor and a control member of the piston, such as a pushbutton, has a certain number of drawbacks.

It is first of all relatively easy to shunt the contactor by applying any element against the contactor such that the latter detects continuously a closed position of the door. In this case, the safety of the operations is not ensured.

Another drawback resides in the fact that two operations are necessary to permit the operation of the piston, namely, on the one hand, closing the door so as to actuate the contactor, on the other, acting on the control member for displacement of the piston, such as a pushbutton. These operations are seen to be difficult for the operator. Moreover, the opening of the door automatically triggers the rise of the piston, prohibiting the stopping of the piston in a withdrawn position, which requires cleaning the piston in a high position. To be able to clean the piston when the latter is in a low position, the users have to frustrate the contactor that closes the door.

SUMMARY OF THE INVENTION

An object of the present invention is thus to provide a filling installation whose safety device, permitting the operation of transfer only when the door is in a closed position, is an inviolable device.

Another object of the present invention is to provide a filling installation whose design is simplified by combining in a single and only member two functions previously carried out by two members.

Another object of the present invention is to provide an installation for filling a receptacle, whose design permits omitting any control member of the piston of the installation on the frame.

Another object of the present invention is to provide a filling installation for a receptacle whose design permits reducing the number of operations to be carried out by the operator.

To this end, the invention has for its object an installation for the filling of a receptacle, in particular an aerosol receptacle, this installation comprising at least a frame delimiting a chamber closed at least partially by a protection door for the reception of an aerosol receptacle to be filled with a liquid product, this chamber housing on the one hand means for holding a cup adapted to receive the filling product in a location situated above the location for reception of the aerosol receptacle, in a position in contact with the valve of the aerosol receptacle, on the other hand a pusher element movable between at least two operative positions to give rise, by pressing on the liquid contained in the cup, to the transfer of this liquid through an opening of said cup into the aerosol receptacle, characterized in that the movement of the pusher element between its different operative positions is controlled by the movement of the opening of the protection door.

The use of the opening of the protection door as the control member for the movement of the pusher element, permits greatly simplifying the installation. Thus, in the case of a pusher element made in the form of a member movable axially of the jack type, the opening of the door controls, as a function of its position, the rising and falling or stopping of the rod of said jack. The integration of the control movement of the movements of the pusher element within the door moreover permits increasing the reliability of such an installation, rendering difficult or even impossible the possibility for an operator to carry out a transfer operation in an open position of the door.

BRIEF DESCRIPTION OF THE DRAWINGS

The invention will be well understood from a reading of the following description of examples of embodiment, with reference to the accompanying drawings, in which.

DETAILED DESCRIPTION OF THE DRAWINGS

Figure 1:
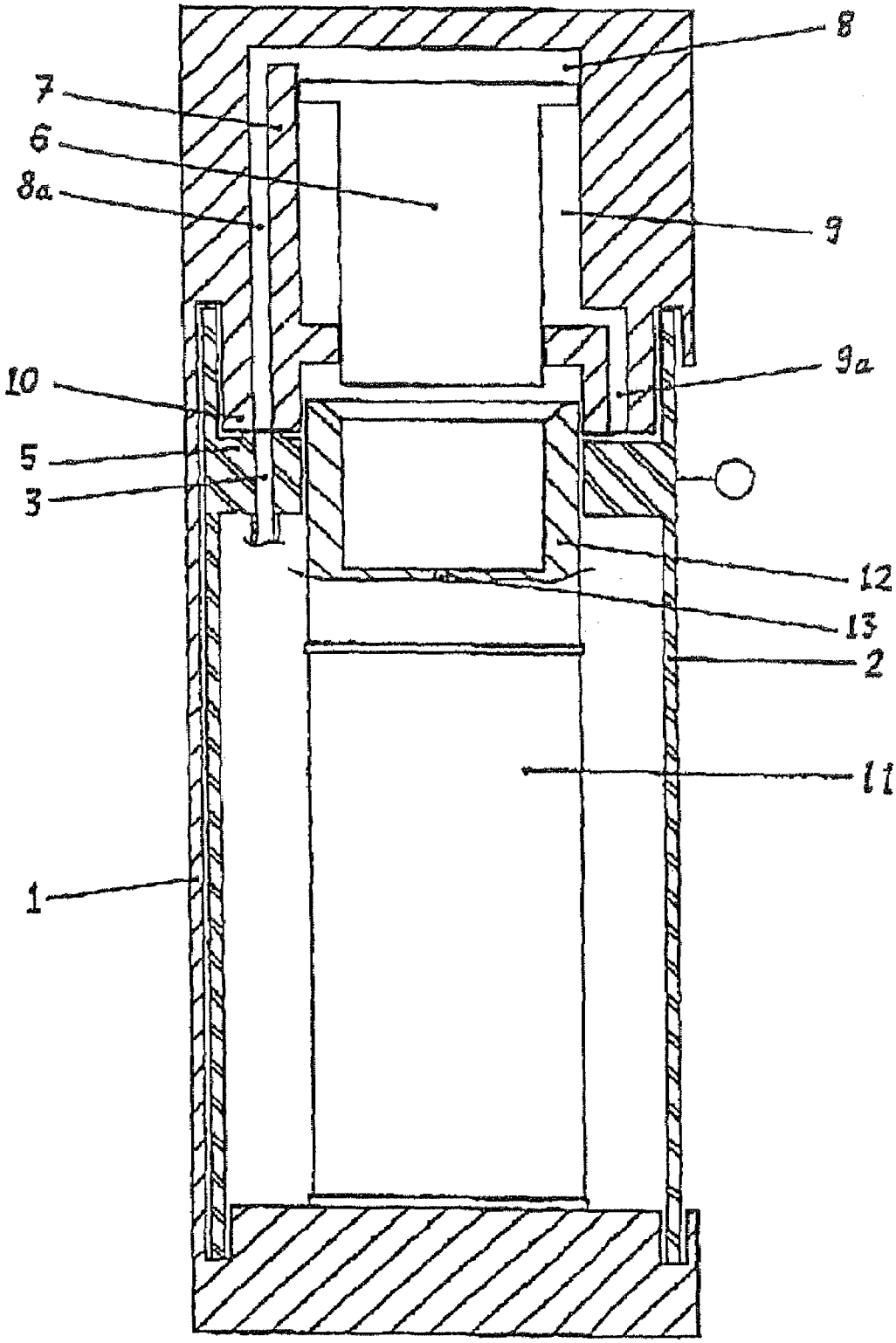
FIG. 1 is a view partially in cross-section of a filling installation according to the invention.

As mentioned above, the installation according to the invention is more particularly adapted for the filling of an aerosol receptacle 11. Such an aerosol receptacle 11 is present in the form of a cylindrical body, provided at its top with a valve. This aerosol receptacle 11 is pre-filled with a propulsive gas. The filling operation has for its object to introduce into such a receptacle a filling liquid, such as paint, the liquid being then able to be propelled by the propulsive gas outside said receptacle with the help of a removable spray disposed on the valve of said receptacle.

Conventionally, the installation comprises at least one frame 1 delimiting a chamber closed by a protection door 2. Preferably, the frame 1 has externally the shape of a cylindrical body. The chamber is adapted to receive an aerosol receptacle 11 to be filled. The filling takes place with the help of a cup 12 provided at its case with an injection opening 13. This opening 13 is adaptable to the valve of the aerosol receptacle 11 and is positioned facing said valve during the transfer operation. To ensure holding the cup 12 in a position superposed above the aerosol receptacle 11, there is generally provided, within the chamber, holding means for the cup 12 in position. These holding means can have a large number of forms. They can be constituted on the one hand by jaws or rails on the frame, on the other hand by a hollow cylinder housing the cup 12 and itself capping the head of the aerosol receptacle. These holding means will not be described in detail hereafter.

The installation further comprises a pusher element 6 movable between at least two operative positions. This pusher element 6 is present in the form of a scraper whose peripheral wall is in sealed bearing contact with the internal wall of the cup, in the introduced condition of the pusher element 6 into the cup 12, to permit, during axial movement of the pusher element 6 in the direction of the bottom of the cup, the passage of the liquid contained in the cup 12 into the aerosol receptacle 11 through the ejection opening of the cup and the valve of the receptacle 11. Once the transfer operation is completed, the pusher element 6 is returned to an inactive position in which it is positioned retracted from the cup. Thus, in the course of passage from the inactive position to the working position, the pusher element moves slidably within the interior of the cup 12 in the direction of the bottom of the cup whilst, during passage from the working position to the inactive position it moves away from the surface forming the bottom of the cup.

Figure 2:
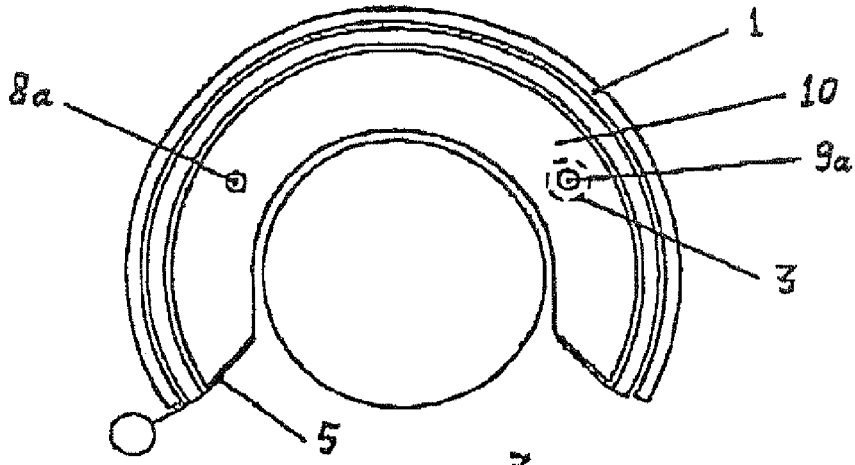
FIGS. 2 to 4 show in top plan cross-sectional views at the level of the stationary rail of the frame, the relative positions of the circuit of the door and its coincidence with the circuit of the frame.
Figure 3:
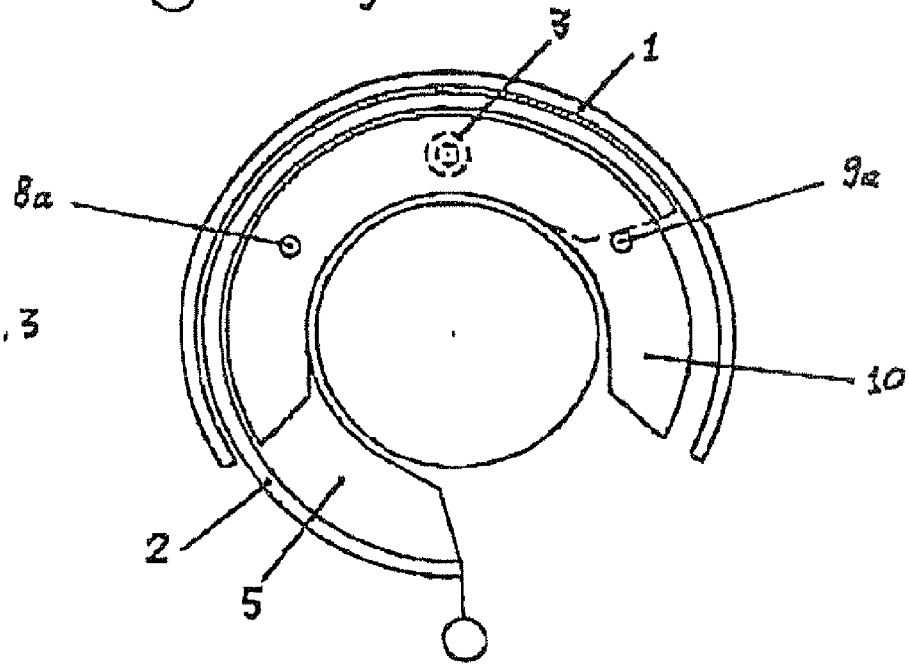
Figure 4:
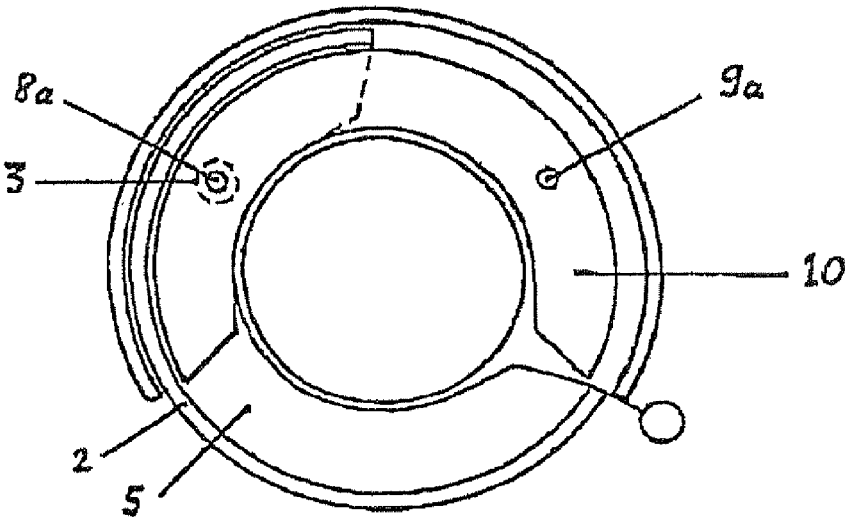

In a manner characteristic of the invention, the movement of the pusher element 6, permitting the passage of said pusher element 6 from an operative position to another position, is controlled by the movement of the opening of the protection door 2, thereby making it possible to be free from a control member positioned on the frame of the machine. This pusher element 6 is a movement with alternating axial movement. Independently of the type of design of the pusher element 6, the door 2, in the closed position, controls the bringing of the pusher element 6 into the working position, which is to say into a position in which it is introduced within the cup 12 and forces the liquid to pass through the injection opening 13 of the cup 12 into the aerosol receptacle 11. The door 2, in open position, controls conversely the movement of the pusher element 6 toward an inactive position, which is to say toward a position withdrawn from the cup 12. It is not troublesome that, in this position, the door 2 remains open because this operation is an operation without risk to the operator to the extent to which the pusher element 6 is withdrawn from the cup 12 and exerts no force on the filling product to be transferred, thereby preventing any risk of bursting of the receptacle by overfilling. Conversely, the fact that the door 2 will be in open position during passage from the working position to the inactive position of the pusher element 6, permits having easy access to this latter as well as to the cup 12 and to the aerosol receptacle 11. The door 2 in the intermediate position, interrupts the movement of said pusher element 6. The passage from this intermediate position of the door 2, to a position either open or closed, during movement of the pusher element 6, gives rise to stopping of this latter in a selected position, and thereby permits the easy cleaning of this pusher element 6. Thus, FIG. 2 shows the door 2 in open position; FIG. 3 the door 2 in intermediate position; whilst FIG. 4 shows the door 2 in closed position.

In the illustrated examples, the pusher element 6 has the form of a piston rod whose control member of the piston rod 6 is constituted by the opening of the protective door 2 which, as a function of its position, controls the insertion of the piston rod 6, the withdrawal of the piston rod 6 or the introduction of movement of the piston rod 6. Again, the open position of the door controls the insertion of the piston rod 6, the closed position of the door 2 controls the withdrawal of the piston rod 6 whilst an intermediate position of the door between the open and closed positions gives rise to an interruption of the movement of the piston rod 6.

In such a configuration, preferably, the piston rod 6 is a cylindrical rod free from counter-relief to avoid any risk of wedging, in particular wedging of the fingers during its withdrawal or insertion.

When the pusher element 6 is a pneumatic or hydraulic control member, as could be the case when this latter is constituted by a jack, a portion of said circuit is integrated to the opening of the protection door 2. Such is the case shown in FIG. 1, in which a portion of the pneumatic circuit, represented at 3 in the drawings, is integrated to the opening of the door. It should be noted that the door 2 is preferably a sliding door, preferably with a surface coaxial to the axis of the chamber. The pneumatic circuit 3 of this door 2 permits applying a circuit integrated into the frame. Thus, the door 2 coacts with a rail 10 for distributing fluid, mounted stationarily within the frame 1, this rail 10 having at various places passageways 8*a*, 9*a* placing in communication the circuit 3 integrated with the door 2 with the control circuit for actuation of the pusher element 6. The portion of the pneumatic or hydraulic circuit 3 of the pusher element 6 on the door 2 passes through a rail 5 of the door, this rail 5 moving along the distributor rail 10 of the frame 1 in the course of movements of the door 2 and ensuring, in parallel with the placing in communication of the integrated circuit of the door 2 with the control circuit of the pusher element 6, the holding in position of the cup 12 within said chamber. Thus, this rail 5 comes, with its upper surface, into contact with the lower surface of the distributor rail 10 and with its front surface into bearing contact against the cup/aerosol receptacle assembly.

The pneumatic circuit of the frame communicates with chambers of the jack. This jack, whose body is represented at 7 and the rod forming the pusher element at 6, comprises in effect two chambers shown at 8 and 9 in the drawings. The chamber 8 permits, during its supply with fluid by the passage 8*a*, the withdrawal of the piston rod 6, whilst the chamber 9 permits, during its supply with fluid by the passageway 9*a*, the insertion of the piston rod 6. The passageway 8*a* thus coincides with the circuit 3 of the door in the open position of the door whilst the passageway 9*a* coincides with the circuit 3 in the closed position of the door 2. The withdrawal of the rod thus can be controlled only in the closed position of the door, thereby avoiding any risk of wounding the operator. Moreover, with such an integration of the circuit into the door, it becomes difficult to frustrate the control system.

As mentioned above, the operation of such an installation is particularly easy. The door is, in a first instance, open. This opening of the door automatically controls the insertion of the piston rod 6 if the latter was not already inserted. It is thus possible for the operator to position, within the chamber of the frame, the cup 12 and the aerosol receptacle 11, the cup 12 being positioned above the aerosol receptacle 11 with its injection opening 13 in contact with the valve of the aerosol receptacle before being filled with paint. Once the assembly is introduced into the chamber, the operator can then re-close the door 2. The closure of the door 2 gives rise to the emptying of the chamber 9 of the jack and the supply of air to the chamber 8 of the jack when the door reaches the closed position. This supply of air to the chamber 8 of the jack gives rise to withdrawal of the piston rod 6 which transfers the liquid contained in the cup 12 through the valve of the receptacle into the receptacle 11. At the end of the path of the piston rod 6, corresponding to a position in which the head of the jack is positioned adjacent the surface forming the bottom of the cup 12, generally bearing against said surface, the transfer operation is terminated. The reopening of the door gives rise, in a manner analogous to that mentioned above, to the withdrawal from the chamber 8 and the supply of air to the chamber 9 when the door reaches the open position. This air supply to the chamber 9 gives rise to the raising of the piston rod 6. The raising or respectively the descent of the piston rod 6 can be interrupted at any time by movement of the door from an open position, or respectively a closed position, toward an intermediate position in which the chambers 8 and 9 are each placed in discharge.

The invention claimed is:

1. Installation for filling a receptacle, said installation comprising:

at least one frame delimiting a chamber for the reception of a receptacle to be filled with liquid product;

a protective door at least partially closing said chamber, said chamber housing means for holding a cup adapted to receive the product to be filled at a position located above the position for receiving the receptacle in a position of contact with a valve of the receptacle;

a pusher element housed in said chamber and movable between at least two operative positions to cause, by pressure on liquid contained in the cup, the transfer of the liquid through an opening of said cup into the receptacle; and a pneumatic or hydraulic control jack, said pusher element forming a rod of said pneumatic or hydraulic control jack, said control jack comprising two chambers each supplied by a passageway, one of the two chambers controlling in a supplied condition an outlet of the rod of the control jack, another of the two chambers controlling an inlet of the rod of the control jack, wherein a portion of a pneumatic or hydraulic control circuit of the pusher element is integrated with the opening of the protective door controlling the movement of the pusher element between the at least two operative positions, said circuit of the door coinciding with a passageway of the output chamber of the rod of the control jack in a closed position of the protective door and with a passageway of the inlet chamber of the rod of the control jack in an opened position of the protective door.

2. Installation according to claim 1, wherein the pusher element is a member with alternative axial movement, the door, in closed position, controlling the bringing of the pusher element into working position, the door, in the open position, controlling the movement of the pusher element toward an inactive position, the door, in an intermediate position, interrupting the movement of said pusher element.

3. Installation according to claim 1, wherein the pusher element has the form of a piston rod whose control member of the piston rod is constituted by the opening of the protection door which, as a function of its position, controls the insertion of the piston rod, the withdrawal of the piston rod or the interruption of movement of the rod of said control jack.

4. Installation according to claim 3, wherein the piston rod is a cylindrical rod free from counter taper to avoid any risk of wedging during its withdrawal.

5. Installation according to claim 1, wherein the door coacts with a fluid distributing rail mounted stationary within the frame, said fluid distributing rail having the passageways for supplying the control jack.

6. Installation according to claim 5, wherein the portion of the pneumatic or hydraulic circuit of the pusher elements provided in the door passes through a rail of the door, said rail of the door moving along the fluid distributing rail of the frame in the course of movements of the door and ensuring, in parallel to the placing in communication of the integrated circuit of the door with the control circuit of the pusher element, the holding in position of the cup within said chamber.

7. Installation according to claim 1, wherein the door is a sliding door that slides along a surface coaxial with the axis of the chamber.

8. Installation according to claim 1, wherein the frame has externally the shape of a cylindrical body.

9. An installation for filling a receptacle, said installation comprising:

a frame;

a chamber delimited by said frame, said chamber receives a receptacle to be filled with liquid product;

a protective door that at least partially closes said chamber;

a cup holding device housed within said chamber that holds a cup adapted to receive the product to be filled at a position located above the position for receiving the receptacle in a position of contact with a valve of the receptacle;

a pusher element housed within said chamber and movable between at least two operative positions to cause the transfer of the liquid through an opening of said cup into the receptacle; and a pneumatic or hydraulic control circuit structured so that movement of the protective door aligns a pneumatic or hydraulic control passage of the door with a pneumatic or hydraulic control passage of the pusher element so as to displace the pusher element between the at least two operative positions.

* * * * *